US008056763B2

(12) United States Patent
Cook et al.

(10) Patent No.: US 8,056,763 B2
(45) **Date of Patent: *Nov. 15, 2011**

(54) BULK CONTAINER ASSEMBLY

(75) Inventors: Matthew R. Cook, Hinsdale, IL (US); Barry Silverstein, Northbrook, IL (US); Kurt Wolf, Evanston, IL (US); John Nobers, Elmhurst, IL (US)

(73) Assignee: LBP Manufacturing, Inc., Cicero, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/835,341

(22) Filed: Jul. 13, 2010

(65) Prior Publication Data

US 2010/0276449 A1 Nov. 4, 2010

Related U.S. Application Data

(60) Division of application No. 11/640,122, filed on Dec. 15, 2006, now Pat. No. 7,770,756, which is a continuation-in-part of application No. 10/804,466, filed on Mar. 19, 2004, now Pat. No. 7,150,377, which is a continuation of application No. 10/151,385, filed on May 17, 2002, now Pat. No. 6,736,289.

(51) Int. Cl.
*B65D 35/56* (2006.01)

(52) U.S. Cl. ..... 222/105; 229/117.3

(58) Field of Classification Search ..... 222/105, 222/93, 100, 94, 95, 183, 184, 165.1; 229/117.27–117.35, 210, 214–219, 162.1, 229/125.12, 125.15

See application file for complete search history.

(56) References Cited

U.S. PATENT DOCUMENTS

| | | | | |
|---|---|---|---|---|
| 1,778,248 | A | 10/1930 | Doughty | |
| 2,134,865 | A | 11/1938 | Essery | |
| 3,054,549 | A | 9/1962 | Leslie | |
| 3,233,817 | A * | 2/1966 | Casady | 229/117.3 |
| 3,944,127 | A | 3/1976 | Bruke et al. | |
| 4,401,239 | A | 8/1983 | Thomassen | |
| 4,541,526 | A | 9/1985 | Berg et al. | |
| 4,653,252 | A | 3/1987 | van de Haar et al. | |
| 4,673,125 | A | 6/1987 | Weaver | |
| 4,781,314 | A | 11/1988 | Schoonover et al. | |
| 5,004,123 | A | 4/1991 | Stoody | |
| 5,050,775 | A | 9/1991 | Marquardt | |
| 5,092,486 | A | 3/1992 | vom Hofe et al. | |
| 5,133,497 | A | 7/1992 | Küppersbusch | |
| 5,163,485 | A | 11/1992 | Hermann | |
| 5,186,359 | A | 2/1993 | Brown et al. | |
| 5,228,589 | A | 7/1993 | Della Riva | |

(Continued)

FOREIGN PATENT DOCUMENTS

GB 2 228 725 A 9/1990

*Primary Examiner* — Lien Ngo

(74) *Attorney, Agent, or Firm* — Brinks Hofer Gilson & Lione

(57) ABSTRACT

A substance container may be used for containing substances such as liquids or powders. The container assembly includes a body. A top panel of the body includes a flap that folds into the back panel of the body. A first aperture is located on the front panel to accommodate a dispensing assembly. A second aperture is also located on the top panel to accommodate a filling assembly. The filling assembly does not protrude past an uppermost plane represented by a top surface of the body.

14 Claims, 13 Drawing Sheets

U.S. PATENT DOCUMENTS 5,353,982 A 10/1994 Perkins et al.
5,356,029 A 10/1994 Hogan
5,402,915 A * 4/1995 Hogan ..... 222/105
5,454,483 A 10/1995 Ichikawa et al.
5,526,958 A 6/1996 Küppersbusch
5,562,227 A 10/1996 Takezawa et al.
5,566,851 A 10/1996 Sasaki et al.
5,673,817 A 10/1997 Mullen et al.
5,746,350 A 5/1998 Nishigami et al.
5,750,216 A 5/1998 Horino et al.
5,806,981 A 9/1998 Schisler
5,830,548 A 11/1998 Andersen et al.
6,024,252 A 2/2000 Clyde
6,053,401 A 4/2000 Andrews, Sr.
6,062,431 A 5/2000 Geshay
6,138,902 A 10/2000 Welch
6,170,715 B1 1/2001 Evans
6,189,736 B1 2/2001 Phallen et al.
6,196,452 B1 3/2001 Andrews, Sr. et al.
6,253,993 B1 7/2001 Lloyd et al.
6,290,124 B2 9/2001 Andrews, Sr. et al.
6,293,432 B1 9/2001 Hartwall
6,439,757 B2 8/2002 Lloyd
6,443,329 B1 9/2002 Rochefort et al.
6,516,625 B2 2/2003 Bedard
6,736,289 B2 5/2004 Cook et al.
6,755,324 B2 6/2004 Geshay

* cited by examiner

BULK CONTAINER ASSEMBLY

CROSS-REFERENCE TO RELATED APPLICATIONS

This application is a divisional of U.S. patent application Ser. No. 11/640,122 filed Dec. 15, 2006 U.S. Pat. No. 7,770,756, which is continuation-in-part of U.S. patent application Ser. No. 10/804,466 filed Mar. 19, 2004, which issued as U.S. Pat. No. 7,150,377, which is a continuation of U.S. patent application Ser. No. 10/151,385 filed May 17, 2002, which issued as U.S. Pat. No. 6,736,289, which are all incorporated by reference herein.

FIELD OF THE INVENTION

The invention relates to containers, and more specifically to portable substance containers that may be intended to contain liquids and powders, and that may be disposable.

BACKGROUND

Portable containers are widely used by a variety of industries to store substances and to allow substances to be transported from one location to another. For example, the catering industry uses containers to transport food and beverages, often in large quantities, from preparation or storage areas to an event. The food containers are often disposable and therefore may be thrown away after the event. Therefore, after the event, the food containers do not have to be returned to the caterer or picked up by the caterer.

Many known beverage containers used by caterers, however, are not disposable. Therefore, the caterer must return to the place of the event, after the event ends, to retrieve the emptied beverage containers. Many known disposable beverage containers are either too small for the catered events or not robust enough to contain large amounts of the beverage over a long period of time. The non-robust containers can tip over or buckle under the weight of the beverage. Moreover, many known disposable beverage containers are difficult for the user to fill and/or empty. Therefore, there is a need for a container assembly that may be disposable, may be robust enough to contain large amounts of a substance, easy to operate and/or maintain its shape for a substantial period of time.

BRIEF SUMMARY

The article described herein is a container that may be shipped flat, later assembled, used to store substances such as liquids or powders, and to allow the substances to be transported. The substance container may be manufactured from corrugated packaging and may be disposable. The substance container may be used by catering companies and/or for take-out or for in store dispensing of beverages. The container may also be used to contain substances such as alcohol, soda, water, juices, cooking or motor oil, liquid or powdered chemicals and detergents.

A substance container may be used for containing substances such as liquids or powders. The container assembly includes a body. A top panel of the body includes a flap that folds into the back panel of the body. A first aperture is located on the front panel to accommodate a dispensing assembly. A second aperture is also located on the top panel to accommodate a filling assembly. The filling assembly does not protrude past an uppermost plane represented by a top surface of the body.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Figure 1:
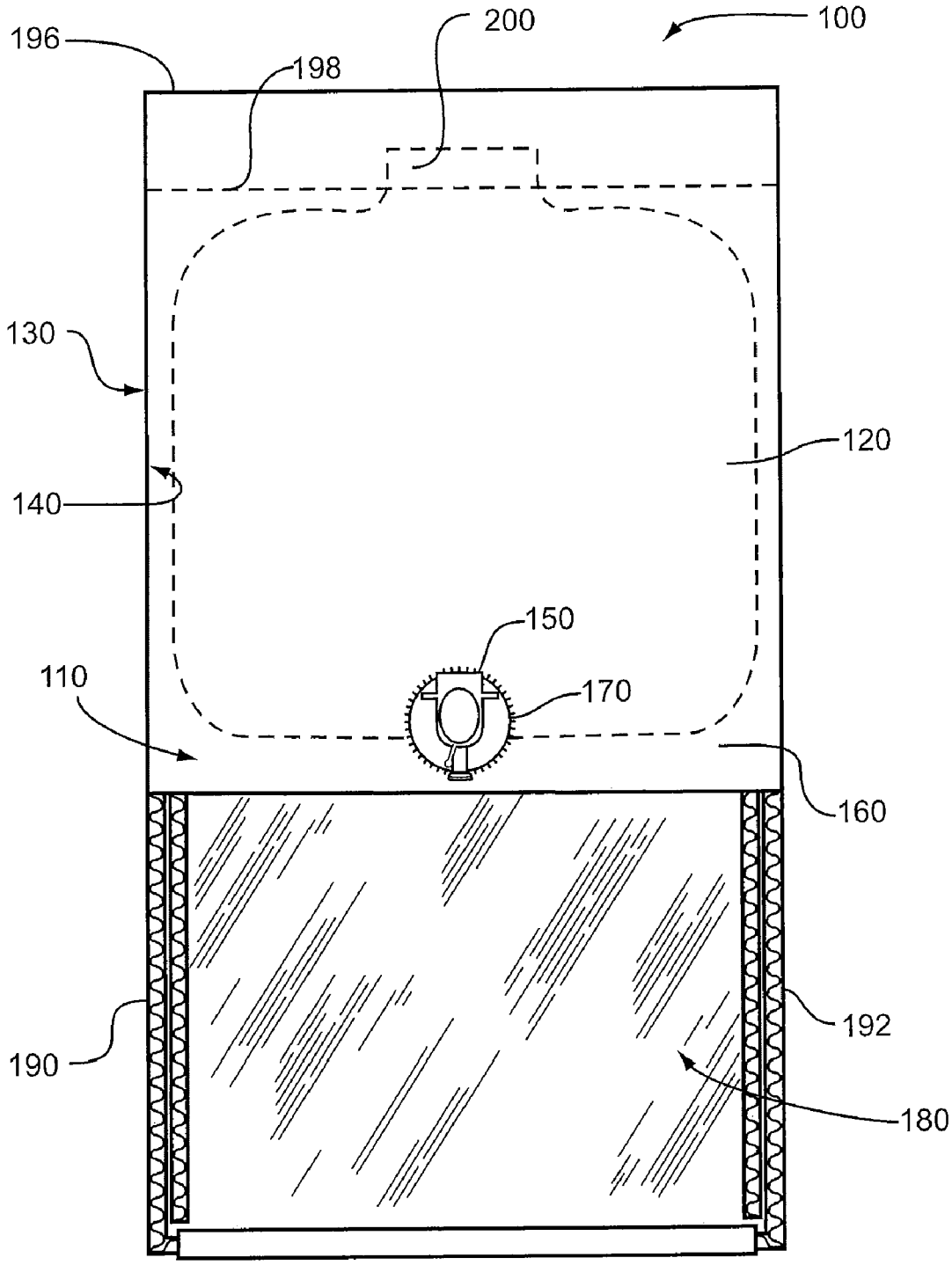
FIG. 1 is a front view of a schematic illustrating a substance container.

FIG. 1 is a front view of a schematic illustrating a substance container 100. The substance container 100 includes a body 110 that may be manufactured using a disposable material such as corrugated packaging, which includes single or double walled corrugated cardboard, paperboard and corrugated plastic. Those skilled in the art will appreciate that other materials may be used for the body 110 such as fluted plastics. Located within the body 110, the substance container 100 includes a bag 120 (shown best in FIG. 3) that may be used to hold substances such as liquids or powders.

The substance container 100 may be used for the transportation or storage of substances. The substance container 100 may be implemented in a variety of manners, for example, for the take-out or in-store dispensing of substances and/or for catering. For example, the substance container 100 may contain liquids such as hot or cold beverages including coffee, alcohol, soda, carbonated beverages, water and juices. The substance container 100 may also contain other liquids such as oils, soaps or liquid chemicals used by a variety of industries. The substance container 100 may also contain other substances including powders such as powdered soaps, detergents and chemical agents. The substance container 100 may also contain food additives, powders and concentrates, such that when liquids such as water or milk, are added and mixed with the substance, foods or beverages may result, such as sports drinks, hot chocolate, flavored drinks, soups and sodas.

An outer surface 130 of the body 110 may include marketing indicia. To market the contained substance, the substance container 100 may include advertising or logos that promote the sale of the product located within the substance container 100. For example, a coffee salesman could deliver samples of coffee to perspective customers using a substance container 100 with the name and logos of the coffee maker printed on the substance container 100. Moreover, a salesperson could advertise a product unrelated to the substance contained within the substance container 100. For example, the salesperson could provide coffee to perspective customers or a focus group using a substance container 100 that includes the logos and marks of the salesperson's company, for example, an insurance company.

To maintain the contained substance, such as coffee, at a certain temperature over a period of time, an interior surface 140 of the body 110 of the substance container 100 may include insulation such as metalized polyester or foil. The metalized polyester or foil may be laminated or otherwise affixed to the interior surface 140 of the substance container 100. In addition, the thickness of the bag 120 used to contain the substance and/or a fluting caliper of the corrugated material of the body 110 can be varied to help insulate the substance for varying durations.

Figure 2:
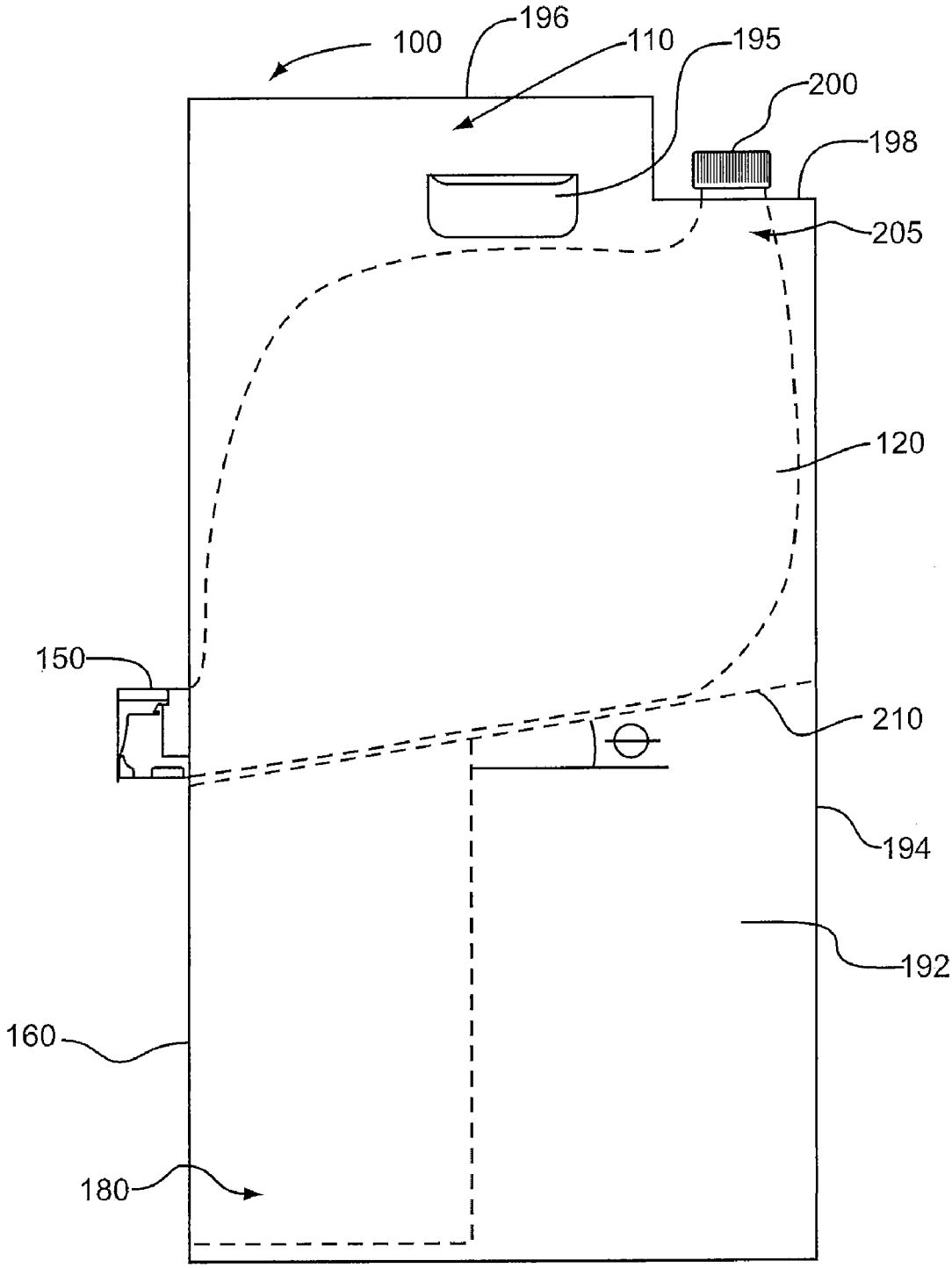
FIG. 2 is a side view of a schematic illustrating the substance container.

FIG. 2 is a side view of a schematic illustrating the substance container. Referring to FIGS. 1 and 2, to dispense substances to a user, the substance container 100 may include a dispensing assembly 150. The dispensing assembly 150 may include an open/close mechanism to controllably dispense substances to the user. The dispensing assembly 150 may protrude beyond a surface of a front panel 160 through an aperture 170 located in the front panel 160.

Below the dispensing assembly 150, a cavity 180 is formed between side panels 190, 192 with an opening in the front panel 160. The cavity 180 may extend as far back as a rear panel 194. The cavity 180 may not extend the full width of the front panel 160. Approximately one-inch strips of the front panel 160 remain around the cavity 180 to add stability. The cavity 180 may provide room for a cup being filled under the spout or the storage of items such as sugar, cream and stirrers.

The side walls 190, 192 may include a double panel thickness to provide strength and stability to a structure of the substance container 100. The double panel thickness is created by folding over the sidewalls 190, 192, as described in more detail below. The substance container 100 may also include apertures 195 located on the side panels 190, 192 that operate as handles to allow the substance container 100 to be carried.

The top panel of the substance container 100 may include an top surface 196 and a recessed surface 198. The bag 120, or at least a portion of it, such as a filling assembly 200, may extend upwardly above the recessed surface 198 though an aperture 205. The filling assembly 200 allows the bag 120 to be filled with substances such as liquids or powders. The bag 120 rests on a bottom support 210. By way of example, coffee may be poured through the filling assembly 200 into the bag 120. The coffee may then be dispensed through the dispensing assembly 150. To aid in the dispensing of the coffee from the bag 120, the bottom support 210 may be positioned at an angle θ inclined towards the dispenser unit 150.

Figure 3:
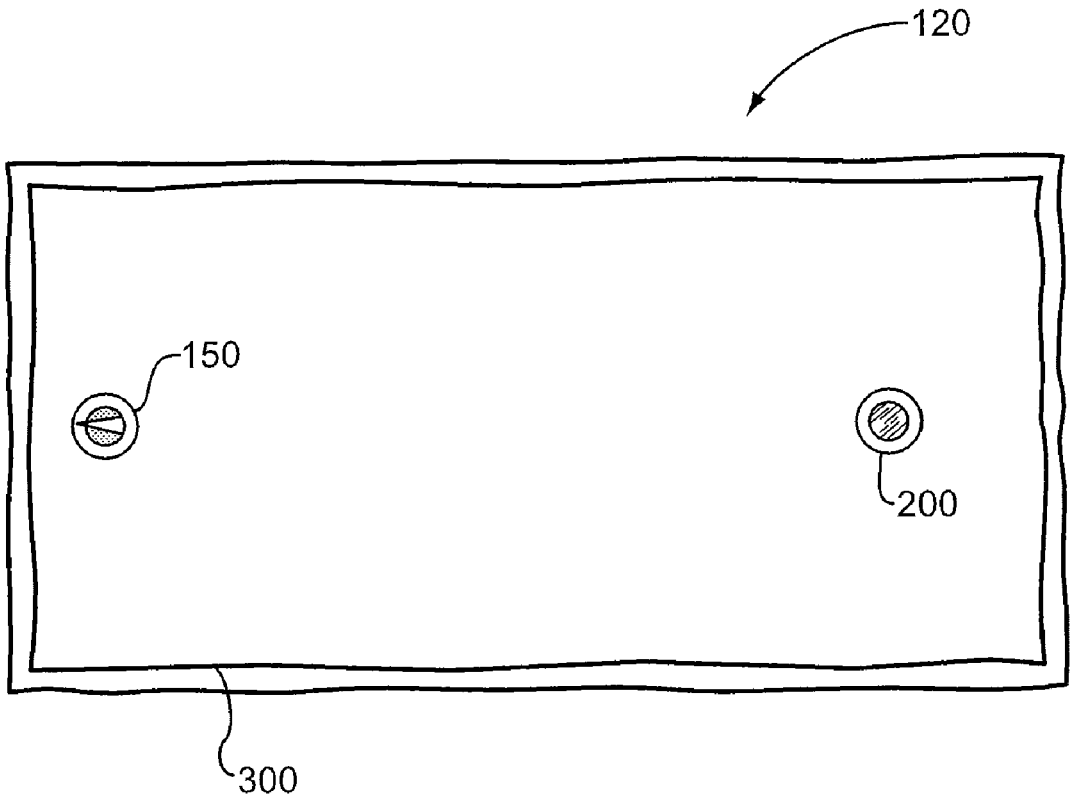
FIG. 3 is plan view of a bag that may be used with the substance container.

FIG. 3 is plan view of a bag 120 that may be used with the substance container 100. Exemplary bag types include a bag 120 manufactured from a two ply polyethylene that contains two fitments, such as the dispensing assembly 150 and the filling assembly 200. The filling assembly 200 includes a 38 MM screw spout with a 38 MM screw cap. Other filling assemblies 200 may, be used such as a filling assembly that includes a snap-on cap or a check valve that opens when the bag 120 is being filled and automatically closes with the bag 120 is not being filled. The filling assembly 200 may also include a tamper resistant mechanism. An exemplary dispensing assembly 150 includes a Waddington & Duval spout and hi-flow press tap. Those skilled in the art will appreciate that other dispensing assemblies 150 may be used such as a pump described below in FIG. 12.

By way of example, various types of film structures may be used to manufacture the bag 120 such as metalized polyester/linear low density polyethelyne, metalized polyester/metalized polyester, metalized polyester/polyethylene, EVOH/metalized polyester, EVOH/polyethylene, NYLON/polyethylene, NYLON/NYLON, NYLON/EVOH, NYLON/metalized polyester, BARRIER ICE, BARRIER ICE/polyethylene, and metalized polyester/BARRIER ICE. By way of example, testing parameters of the bag 120 may include a minimum test duration of three hours, heat retention testing, a taste test, such as with coffee or tea, material and product compatibility, perimeter seal integrity, fitment assembly seal integrity, fitment hot product integrity and ease of use.

By way of example, in a three and five gallon capacity application, an exemplary bag size includes 27 inches I.D. in length and 18½ inches I.D. in width with the fitments located 8⁷⁄₁₆ inches from the edge of the bag 120 along the width. The bag 120 can include a one piece assembly or two or more pieces sealed together using a perimeter heat seal 300 or other type of sealing mechanism. Those skilled in the art will appreciate that the bag size can be changed without interfering with the type of fitments used or the placement location of the fitments to the bag 120. Those skilled in the art will appreciate that other bag types or other mechanisms other than those described could also be used with the substance container 100.

Figure 4:
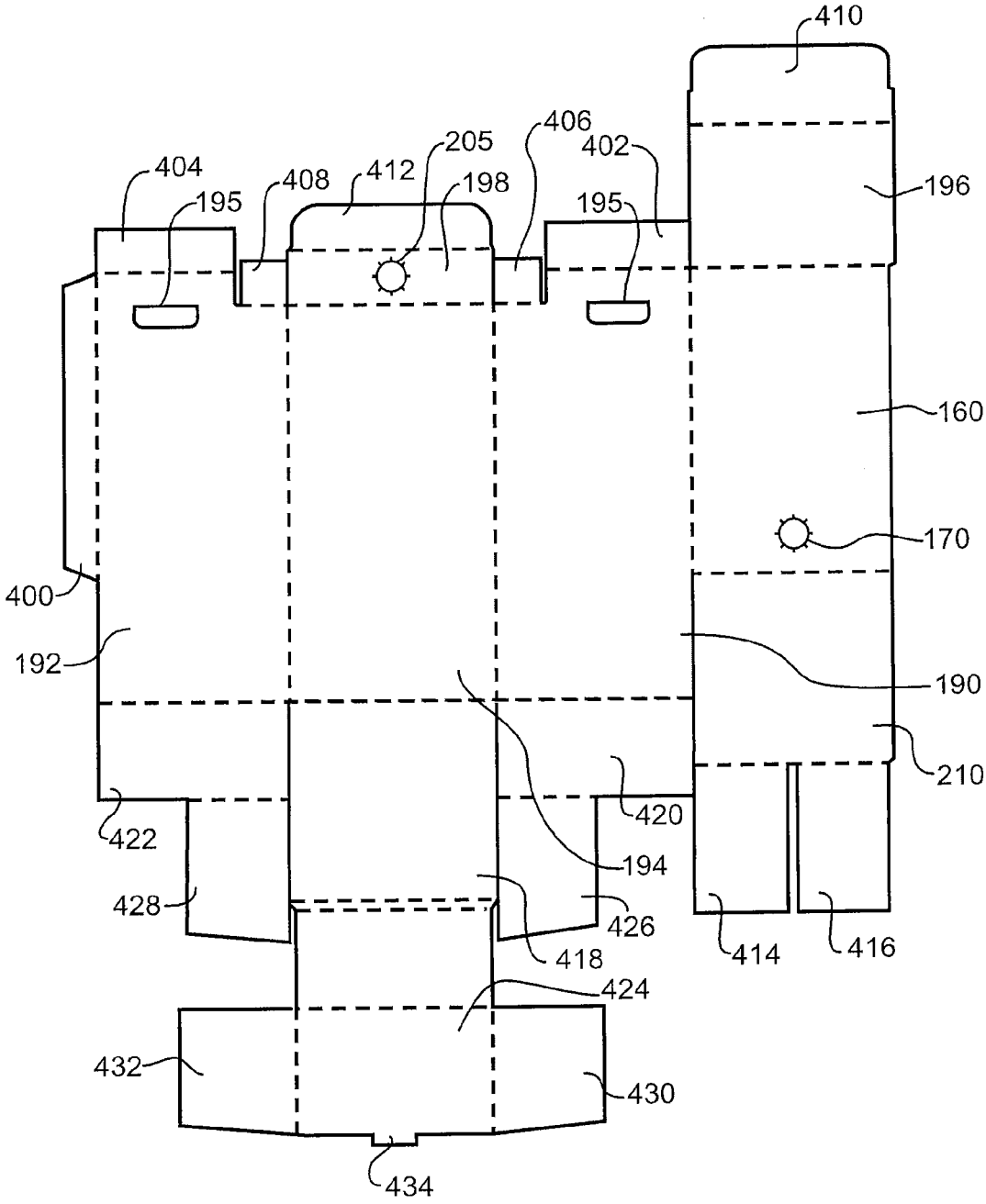
FIG. 4 is a plan view of a blank from which the substance container may be assembled.

FIG. 4 is a plan view of the substance container 100 in its fold-flat configuration. The substance container 100 may be shipped flat for ease of shipping. Fold lines of the substance container 100 are shown in dashed lines. The substance container 100 includes the front panel 160, side panels 190, 192 and rear panel 194. A glue tab 400 extends along side panel 192. When the substance container 100 is partially assembled in a fold-flat configuration for shipping, shown best in FIG. 6, the tab 400 is affixed, such as by gluing, to an interior surface of the front panel 160. The side panels 190, 192 include apertures 195 that may be used as handles for the assembled substance container 100.

The side panels 190, 192 include tabs 402 and 404 respectively, which fold to provide stability the top surface 196 of the top panel. Likewise, the side panels 190, 192 include tabs 406 and 408 respectively, which fold to provide support to the recessed surface 198 of the top panel. The top surface 196 includes a tab 410 that folds to form a surface perpendicular to the recessed surface 198 when the substance container 100 is assembled. The recessed surface 198 includes a tab 412 that folds to abut the tab 410 when the substance container 100 is assembled (shown best in FIG. 11).

To support the bag 120, the substance container 100 includes the bottom support 210. The bottom support 210 folds towards rear panel 194. The bottom support 210 includes flaps 414, 416 that fold to abut the rear panel 194 to form a double panel thickness at the rear panel 194. The rear panel 194 includes bottom panel 418 that folds to create a bottom surface of the substance container 100. The side panels 190, 192 include flaps 420 and 422 respectively, which fold to abut the bottom panel 418 (shown best in FIG. 9).

To complete the bottom surface and cavity 180 of the substance container 100, the bottom panel 418 includes a cavity back panel 424 that include flaps that include flaps 426 and 428. The cavity back panel 424 folds to create a back surface for the cavity 180. The cavity back panel 424 may also be eliminated and the rear panel 194 of the substance container 100 may be used as the back surface of the cavity 180. Flaps 420, 422 further include flaps 426 and 428 respectively, which fold to create a support for the cavity back panel 424 (shown best in FIG. 9). The cavity back panel 424 further includes flaps 430 and 432 that fold to abut side panels 190, 192 to create a double panel thickness for the side surfaces. The double panel thicknesses may create extra support for the substance container 100.

The cavity back panel 424 may also include a tab 434 that fits into a slot (not shown) of the bottom panel 418 to help maintain a position of the cavity back panel 424.

Figure 5:
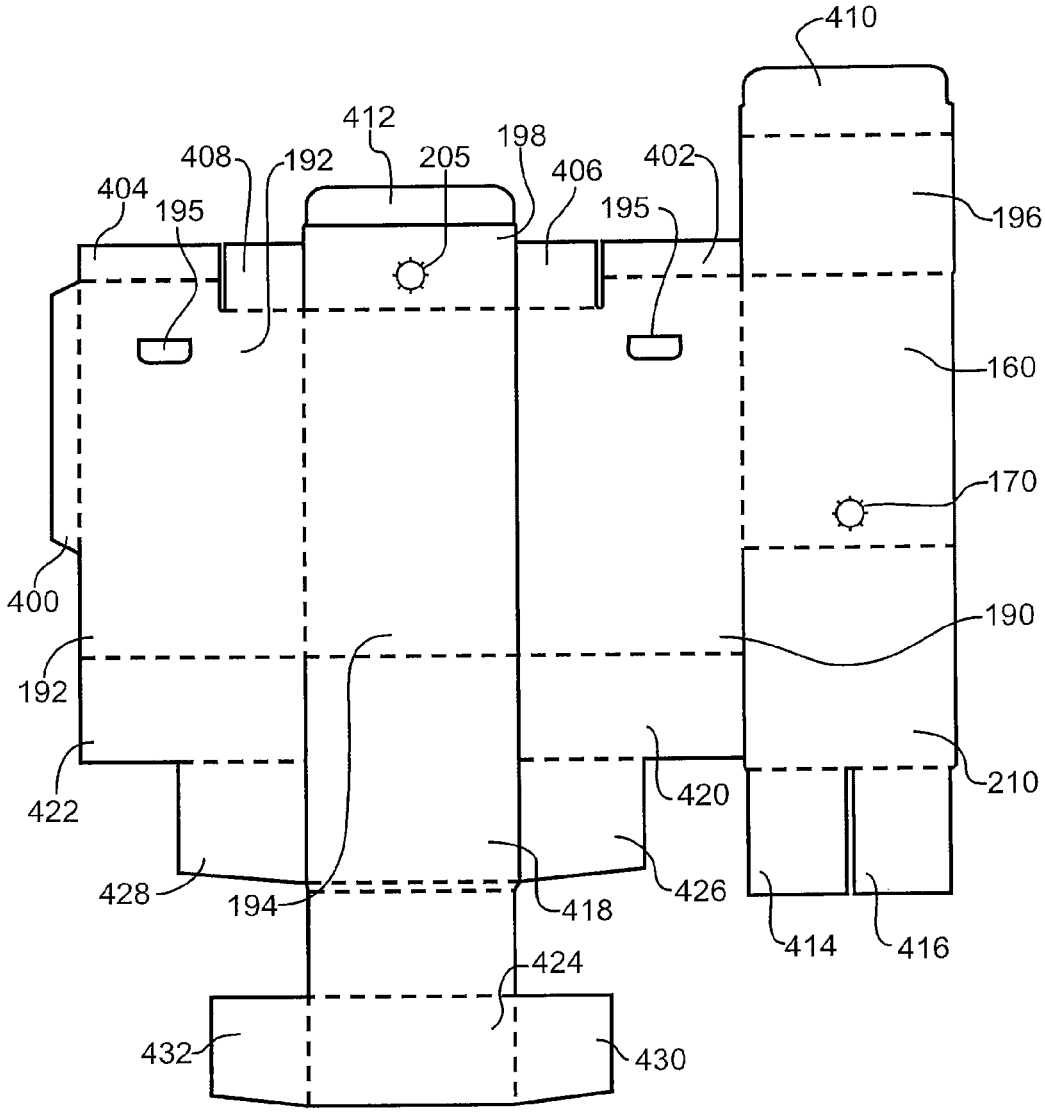
FIG. 5 is a plan view of another blank of a substance container.

FIG. 5 is a plan view of another blank of the substance container 100. The blank shown in FIG. 5 is a larger version of the blank shown in FIG. 4. By way of example, the blank shown in FIG. 4 includes a width of 36⅛ inches from the left most edge to the right most edge, and a length of 48 3/16 inches from the top most edge to the bottom most edge. A substance container 100 constructed from the blank in FIG. 4 may accommodate three gallons of a liquid. The blank shown in FIG. 5 includes a width of 46⅛ inches from the left most edge to the right most edge, and a length of 53 9/16 inches from the top most edge to the bottom most edge. A substance container 100 constructed from the blank in FIG. 5 may accommodate five gallons of a liquid.

Figure 6:
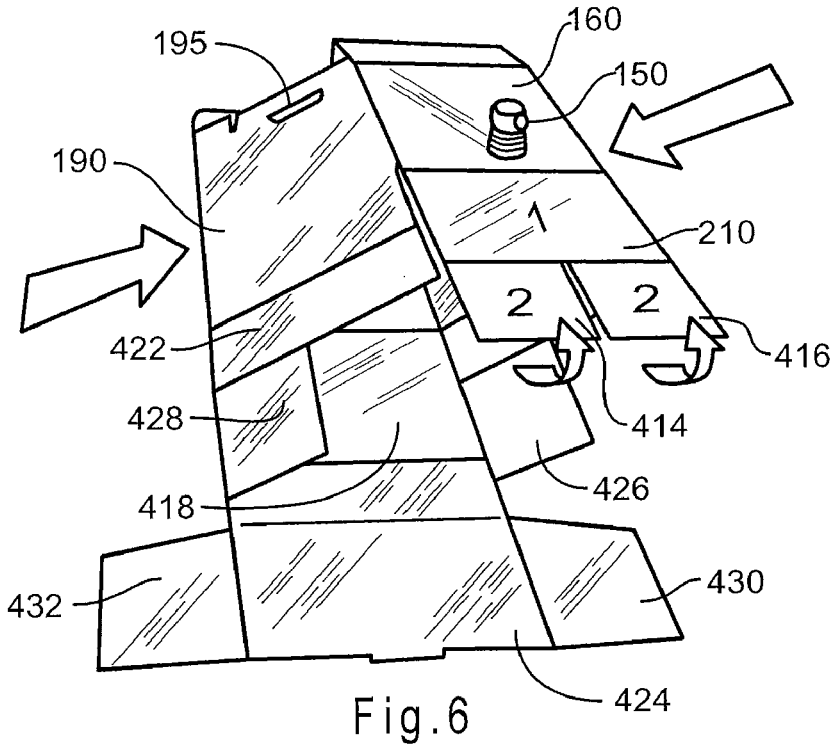
FIG. 6 is a perspective view of the substance container in a fold-flat configuration, according to a step of an assembly process.

FIG. 6 is a perspective view of the substance container 100 in a fold-flat configuration, according to a first step of an assembly process. The substance container 100 is assembled by folding the above-described blanks along determined lines. Initially, the substance container 100 is positioned into a generally three-dimensional rectangle.

Figure 7:
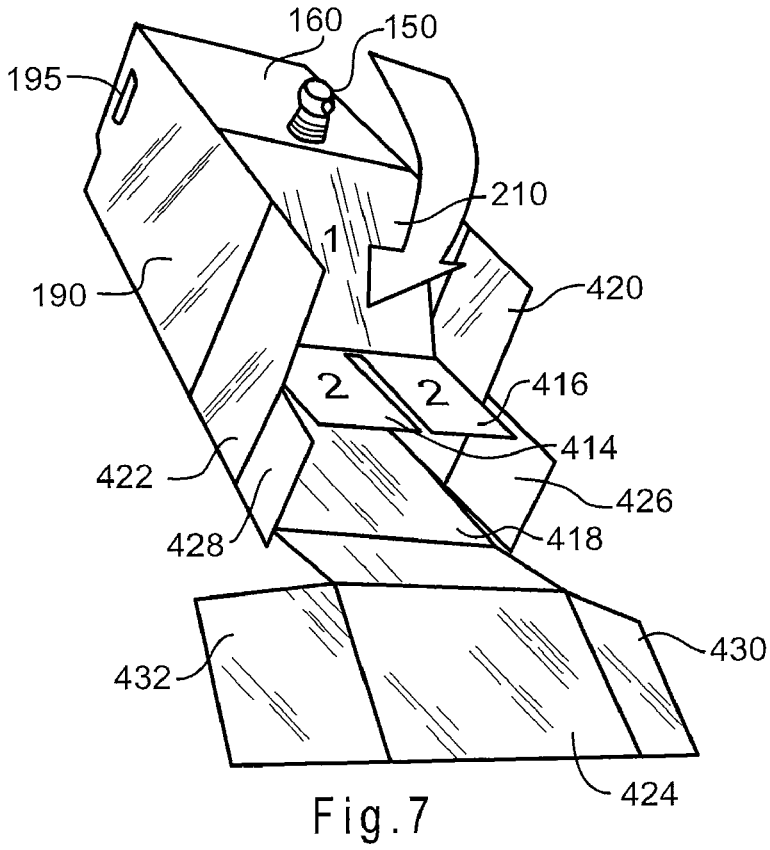
FIG. 7 is a perspective view of the substance container according to a step of the assembly process.

FIG. 7 is a perspective view of the substance container 100 according to another step of the assembly process. The bottom support 210 is folded towards the rear panel 194 and the flaps 414, 416 are folded to abut the rear panel 194.

Once the substance container 100 is fully assembled, the flaps 414, 416 position the bottom support 210, for example at an inclined angle θ (FIG. 2), and sustain a position of the bottom support 210.

Figure 8:
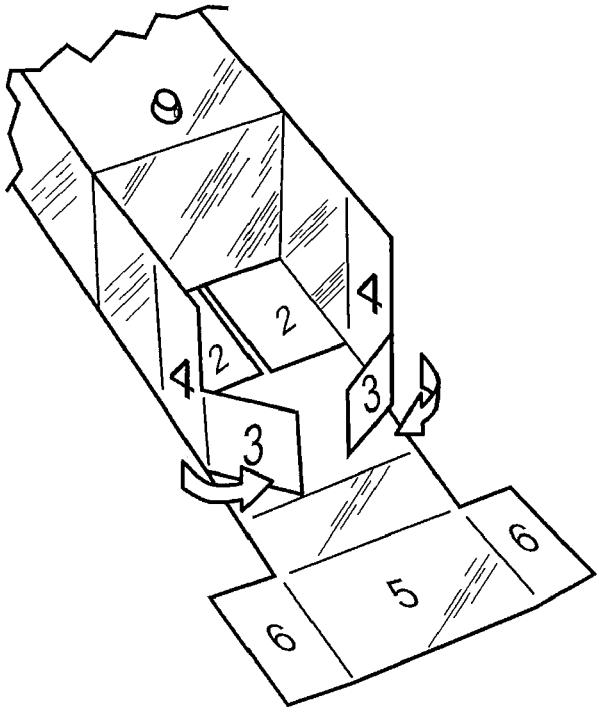
FIG. 8 is a perspective view of the substance container according to a step of the assembly process.
Figure 9:
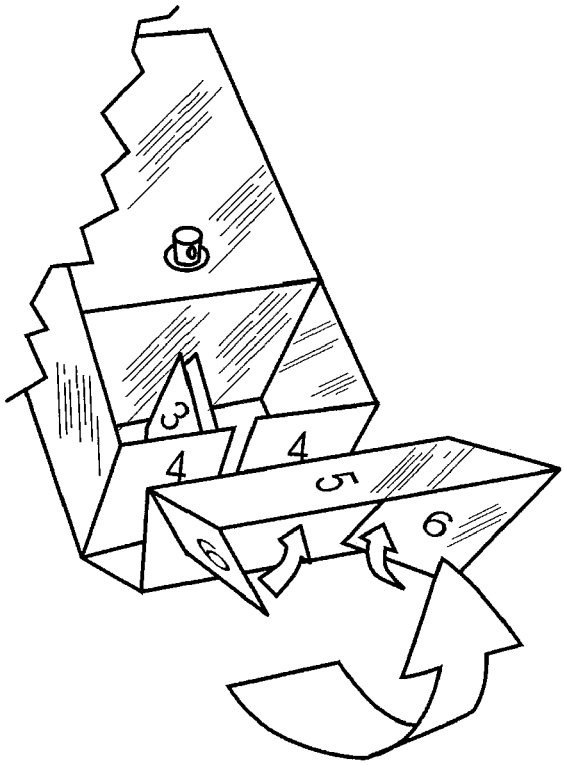
FIG. 9 is a perspective view according to step of the assembly process.

FIGS. 8 and 9 are perspective views of the substance container 100 according to other steps of the assembly process. When the bottom support 210 and flaps 414, 416 are positioned, flaps 420, 422 are folded parallel to a bottom surface of the substance container 100 and flaps 426, 428 are folded up to form a support for the cavity back panel 424. The cavity back panel 424 is folded up to abut an edge of the flaps 426, 428.

Figure 10:
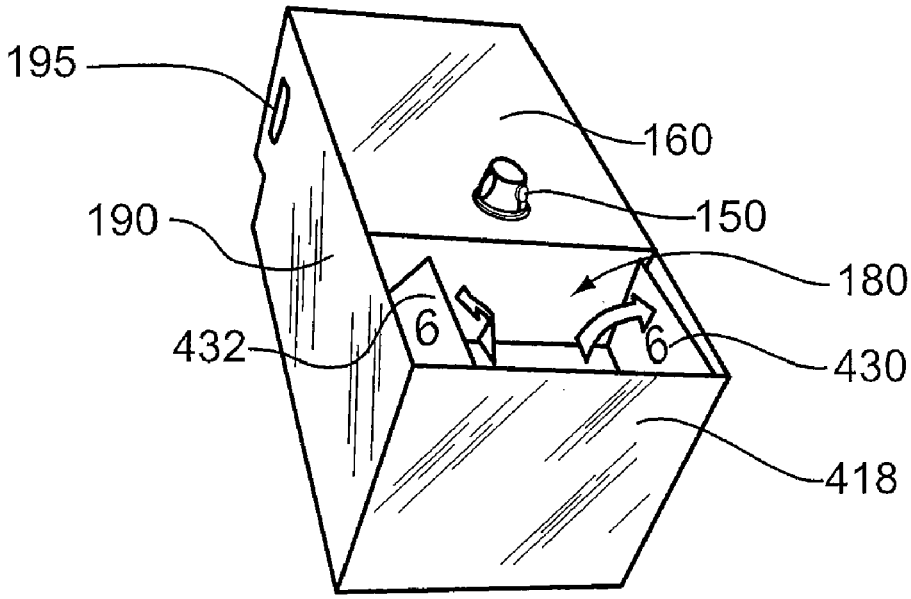
FIG. 10 is a perspective view according to a step of the assembly process.

FIG. 10 is a perspective view according to another step of the assembly process. Flaps 430, 432 are folded over to abut the side panels 190, 192, to create a double panel thickness. With the bottom portion of the substance container completely assembled, the cavity 180 is formed.

Figure 11:
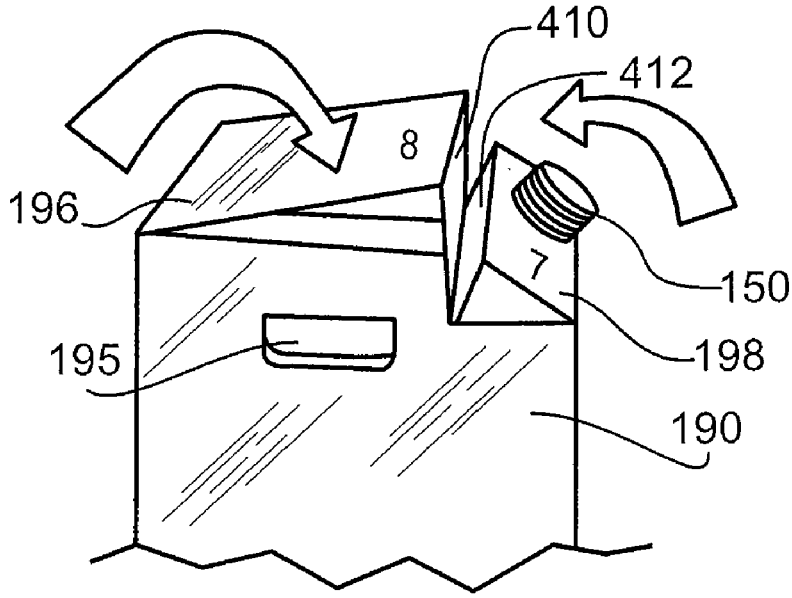
FIG. 11 is a perspective view according to a step of the assembly process.

FIG. 11 is a perspective view according to another step of the assembly process. To complete a top portion of the substance container 100, top surface 196 and recessed surface 198 are folded over and tucked in by folding down flaps 410, 412 to abut each other. After the top portion of the substance container 100 is assembled, the filling assembly 150 is located below a plane of the top surface 196. The recessed portion of the top of the substance container 100 allows for a pleasant appearance and for the substance containers 100 to be stacked.

Figure 12:
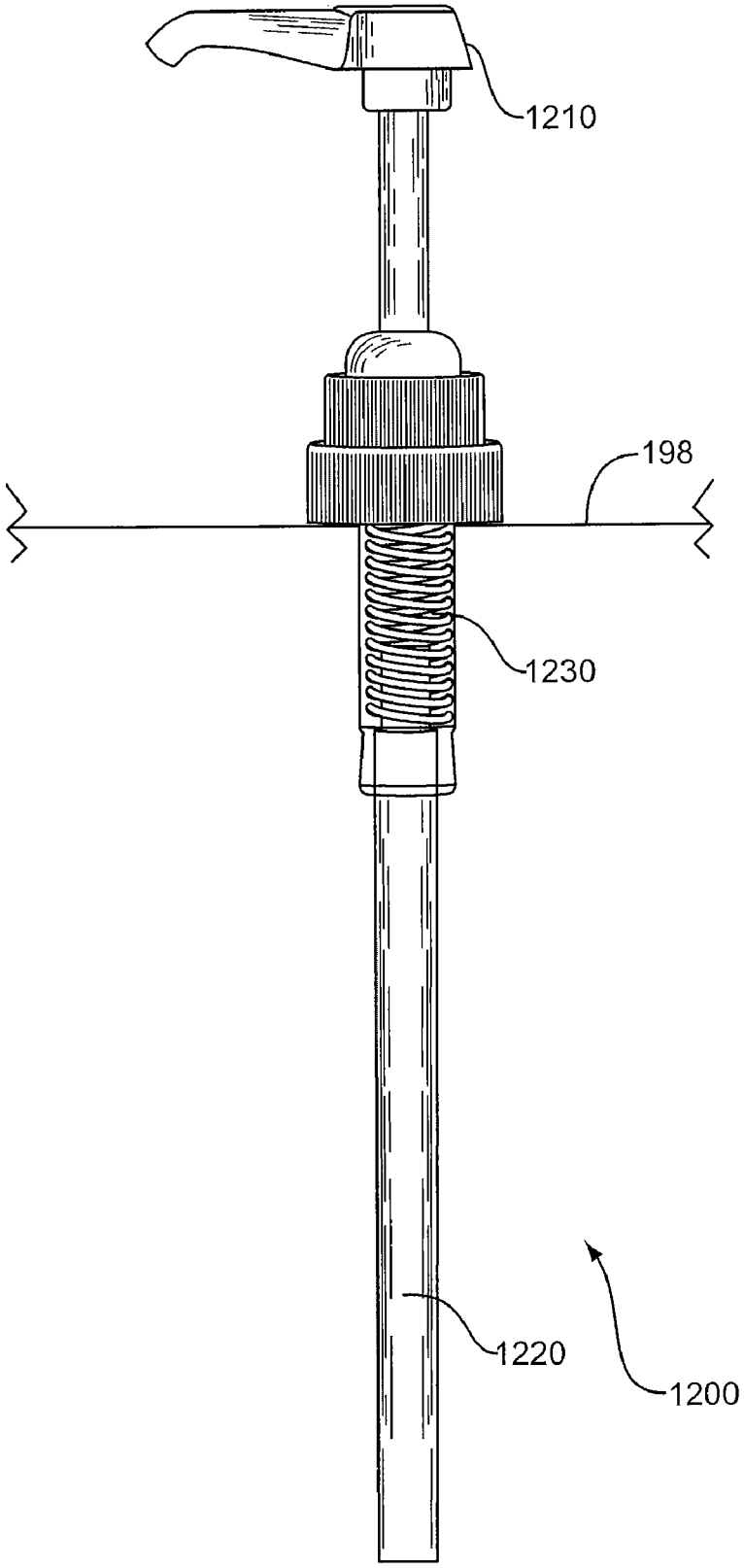
FIG. 12 is a partial side view of the substance container including a pump.

FIG. 12 is a partial side view of the substance container 100 including a pump 1200. The pump 1200 may include a dispenser unit 1210 and a tube 1220 to dispense substance from the substance container 100 to the user. By way of example, the pump 1200 is pushed in to release the substance from the tube 1220. The pump 1200 may also include a spring 1230 to automatically push the pump 1200 out after it has been pushed in. As the pump 1200 is pushed out, the substance is drawn from inside the bag 120 to the tube 1220 of the pump 1200. Therefore, the pump 1200 may be pushed in again to release more substance, and the spring pushes the pump 1200 out when the pump is disengaged. This process may be repeated as desired. Those skilled in the art will appreciate that a variety of types of pumps could be used and that the pumps may be located at different locations on the substance container 100, depending on the design of pump. For example, the pump 1200 may be located at the top of the substance container 100, such as at aperture 205, or on a side of the substance container 100, such as at aperture 170.

FIGS. 13-17 show another version of the substance container described in FIGS. 1-12. The substance container described in FIGS. 13-17 may have a similar basic structure to the substance container described in FIGS. 1-12 and may be manufactured in a similar manner to what was described previously.

Figure 13:
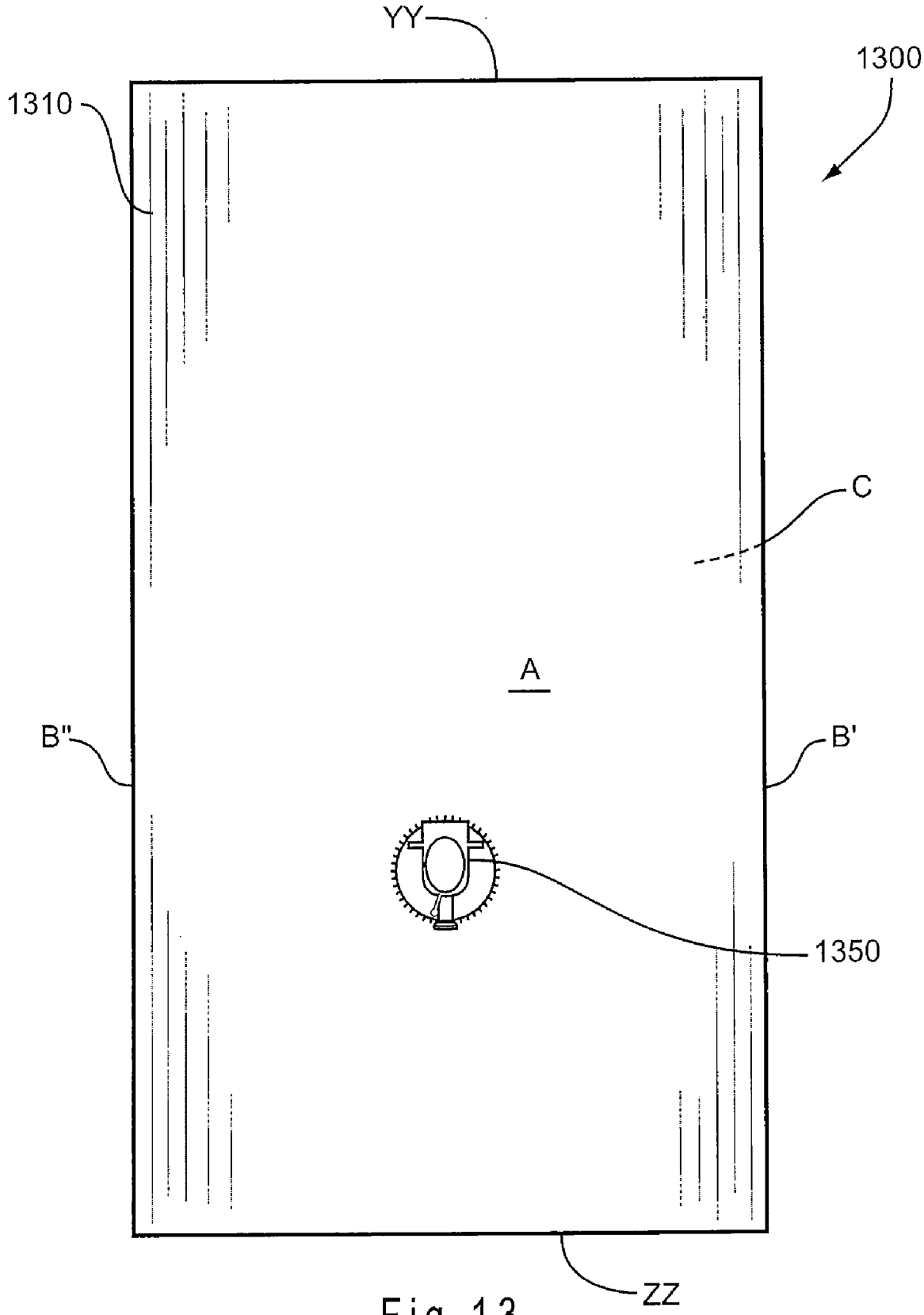
FIG. 13 is a front view of another substance container.

FIG. 13 is a front view of a substance container 1300. The substance container includes a body 1310. The body 1310 includes a front panel A, a first side panel B', a second side panel B", a back panel C a top panel YY and a bottom panel ZZ. The substance container 1300 may include a dispensing assembly 1350 similar to the dispensing assembly 150 described previously. The substance container 1300 may be used for the purposes described previously. Front panel A does not include cavity 150 described in FIGS. 1-12. However, front panel 1350 may be modified to include cavity 150.

Figure 14:
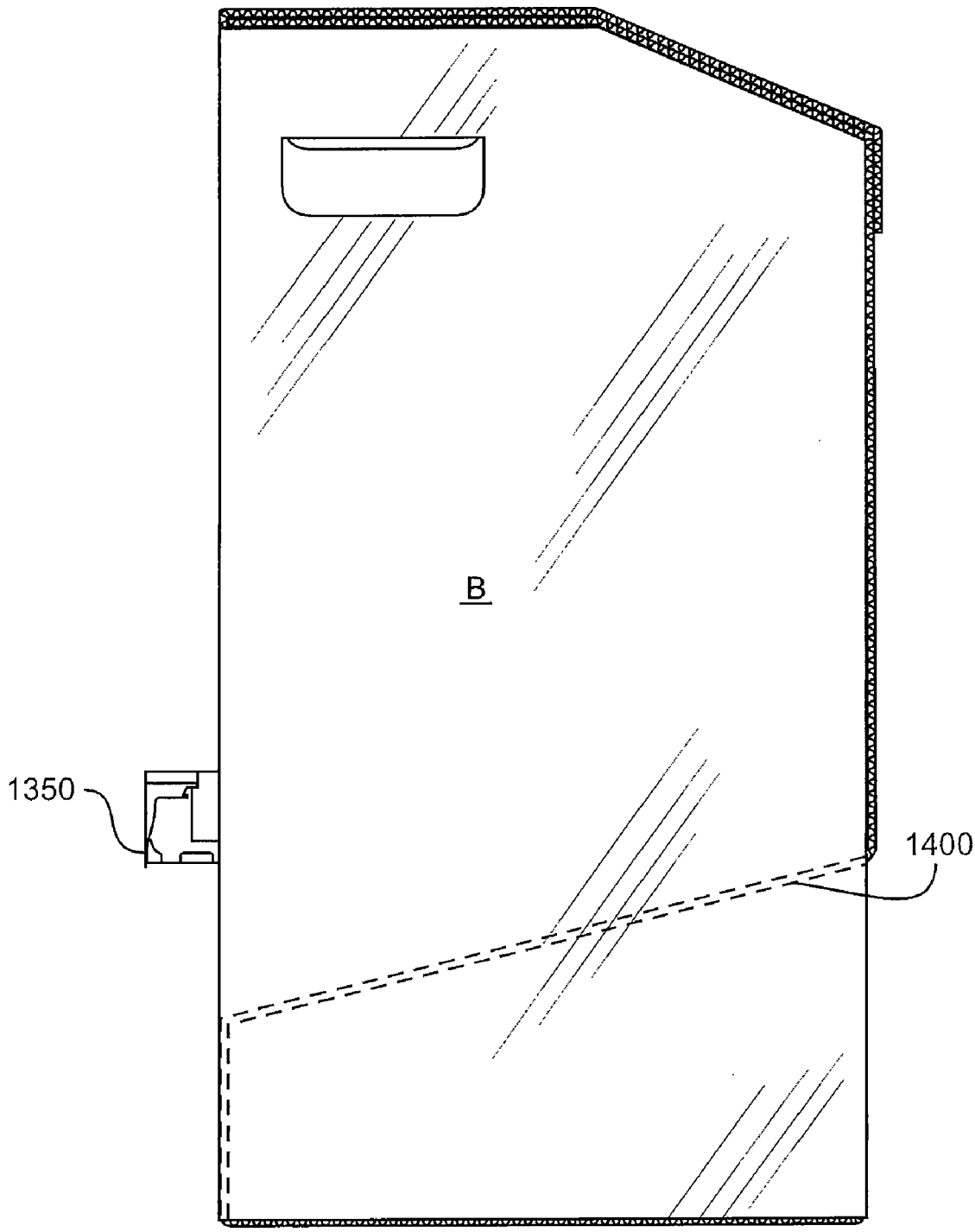
FIG. 14 is a side view of the substance container of FIG. 13.

FIG. 14 is a side view of an alternative embodiment of the substance container 1300. The substance container 1300 may include a bottom support 1400 to buttress the bag 120. The bottom support 1400 may be positioned at an angle relative to a plane represented by the bottom panel ZZ of the body of the substance container 1300.

Figure 15:
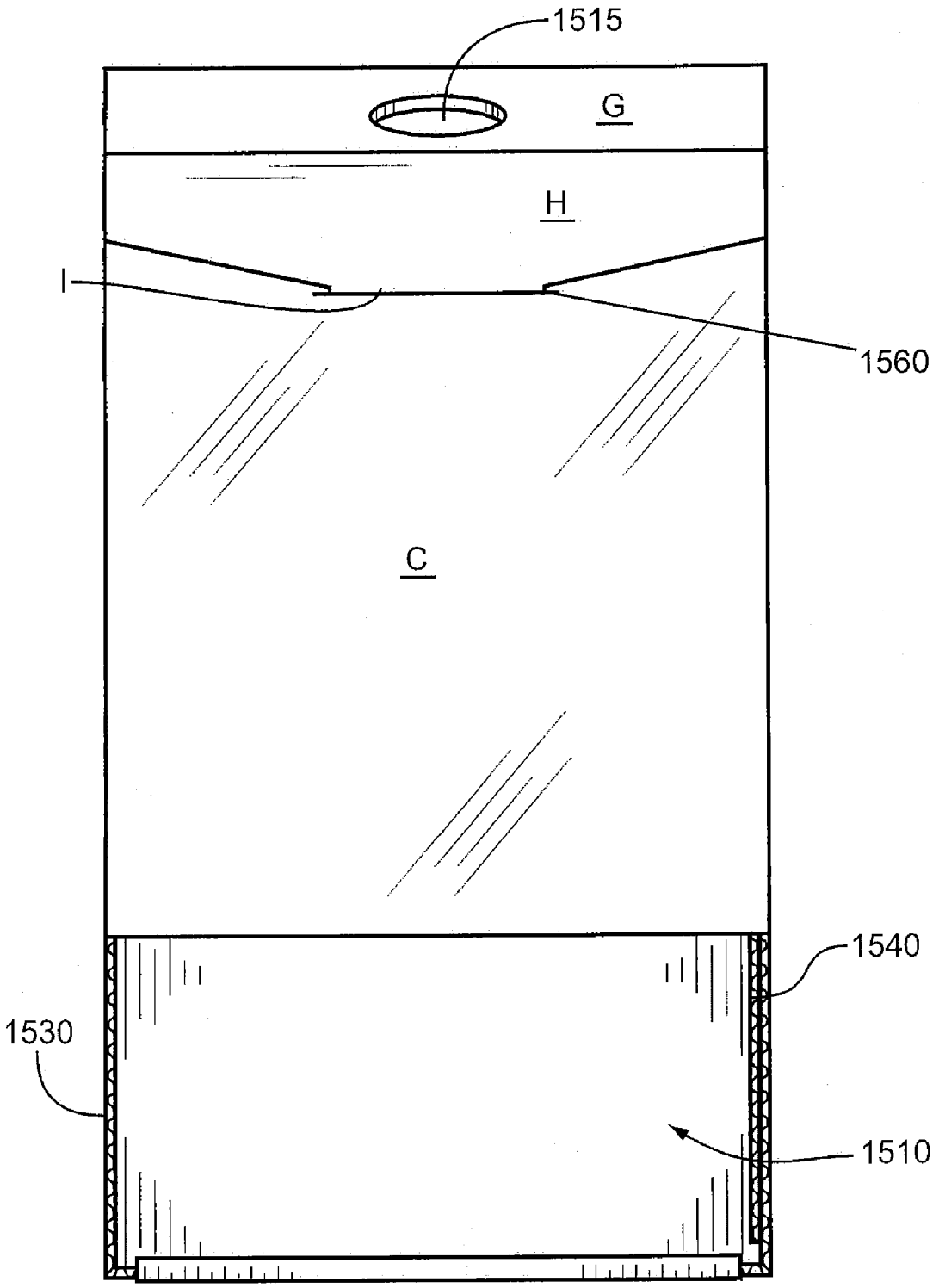
FIG. 15 is a back view of the substance container of FIG. 13.

FIG. 15 is a back view of a substance container 1300. An opening 1515 in the top panel YY, such as section G, may accommodate a filling assembly, such as the one described above, such that the filling assembled does not protrude past a plane represented by an uppermost surface of the body when in the assembled state. A cavity 1510 is formed between side panels 1530, 1540 with an opening in the back panel C. The opening may be a slit cut through the back panel C. The cavity 1510 may extend as far back as flaps R. The cavity 1510 may not extend the full width of the back panel C. Approximately one-inch strips of the back panel may remain around the cavity 1510 to add stability. The cavity 1510 may provide room for storage of items such as cups, sugar, cream, and stirrers. The cavity 1510 may also be used to add weight to the back side in order to help avoid allowing the storage container 1300 to tip over.

The side wall 1540 may include a double panel thickness to provide strength and stability to a structure of the substance container 1300. The double panel thickness may be created in the manner described previously. Alternatively, the side wall 1530 may also include a double panel thickness.

Figure 16:
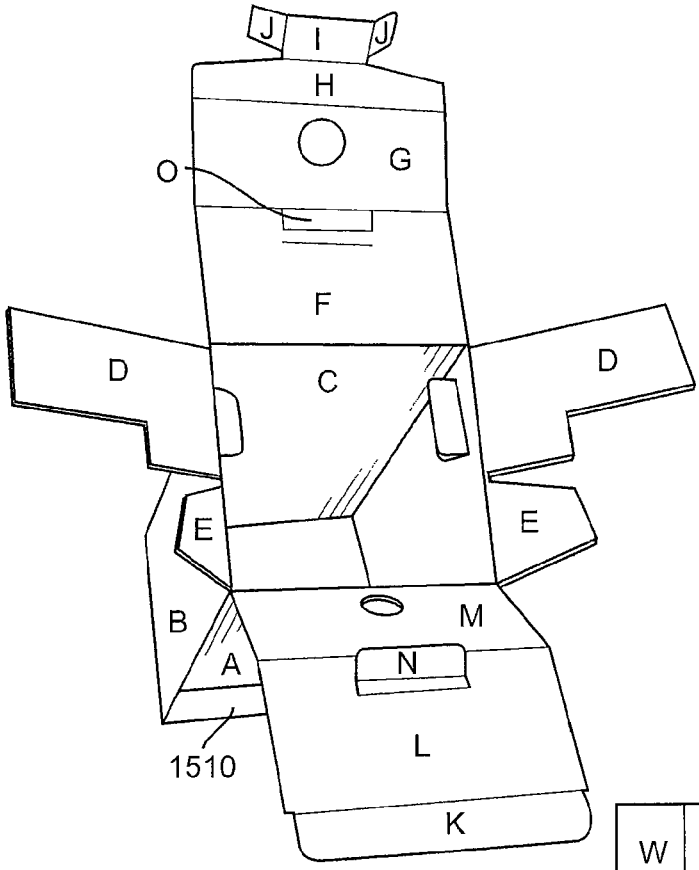
FIG. 16 is a top perspective view of an open container of FIG. 13.

FIG. 16 is a top perspective view of an open substance container, to show an assembly process. Fold lines of the substance container 1300 are shown. The top of the substance container may be assembled by folding sides D and E. Alternatively, folding sides D and E may be omitted, depending on an implementation. Sides D and E may lay perpendicular to sides B to cover the contents of the substance container 1300. A first top panel, including sides K, L, M, may be folded such that side K is folded against side C, side L overlies side D and side M overlies side E. A second top panel, including sides F, G, and H, may be folded such that flap O is lined with flap N to create a handle opening. Other handles may be used such as handles that are not integral with the second top panel or handles that are integral with the top panel and protrude from the top panel. More or less top panels may be used. Sides J of tab I, and side I, engage slit 1560 of the back panel C. Once inside, sides J may fan out to lock tab I in place to provide a secure fit and stability to the top panel of the structure.

Figure 17:
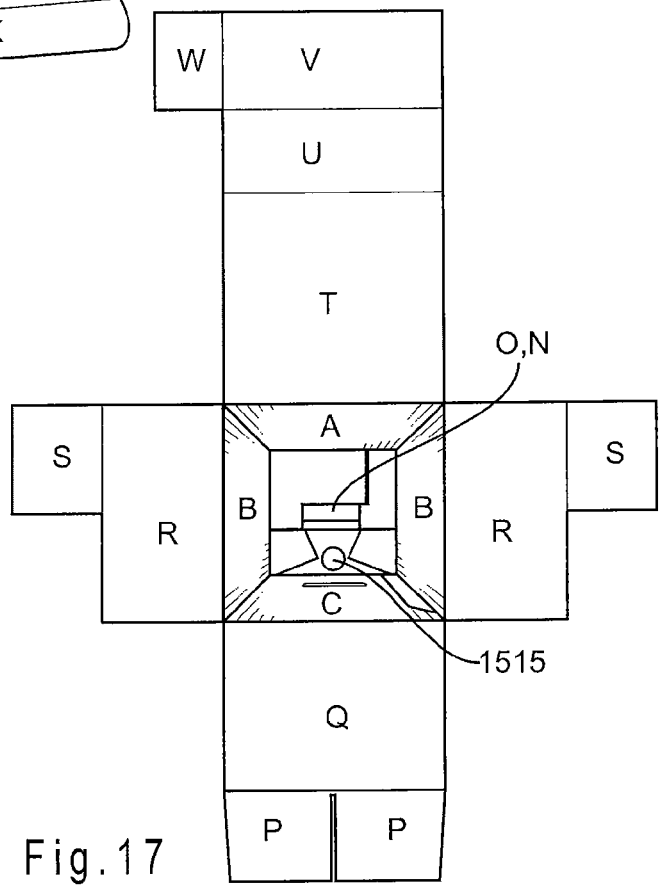
FIG. 17 is a bottom perspective view of an open container of FIG. 13.

FIG. 17 is a bottom perspective view of an open substance container according to a step of an assembly process. Flap Q may be folded into the substance container 1300 to form the bottom support 1400. Flap P may fold down to support the bottom support 1400 from the bottom flap T of bottom panel ZZ. Panel Q may be positioned at a downward angle θ towards the dispenser assembly 1350 to help accommodate flow of substances towards the filling assembly 1350. Alternatively, the bottom support 1400 may rest parallel to the bottom panel ZZ. Flap P may rest vertically against front panel A. Flaps S and R may fold inward such that flaps S stand vertically and adjacent to each other. Flaps S may create a flat surface that is perpendicular to sides B and may be used to help support the bottom support 1400. Flap T may be folded over flap R to form the bottom panel ZZ. Flap U may fold inward directly on top of flaps R. Flap V may fold in to be perpendicular to flap S, to create a back wall of the cavity 1510. Flap W may presses against the inside of side panel B to create a double wall thickness. Flap W may be located on one or both of the sides, or may be omitted altogether.

While various embodiments of the invention have been described, it will be apparent to those of ordinary skill in the art that may more embodiments and implementations are possible that are within the scope of the invention.

We claim:

1. A substance container, the container comprising:

a body including a front panel, a back panel, a first side panel, a second side panel, a top panel, a bottom support and a bottom panel;

a first aperture located in the front panel, wherein the first aperture accommodates a dispensing assembly; and a second aperture located in the top panel wherein the second aperture accommodates a filling assembly; and wherein the first side panel, the second side panel, the bottom panel and the back panel form a cavity below the bottom support that accessible from an outside of the body without disassembling the body, wherein an opening of the cavity is positioned opposite the front panel having the aperture to accommodate the dispensing assembly.

2. The container of claim 1 further including a bag contained in the body.

3. The container of claim 1 wherein the bottom support is positioned at an angle relative to a plane represented by the bottom panel of the body.

4. The container of claim 3 further including insulation disposed on a least a portion of an interior surface of the body.

5. The container of claim 1 wherein the top panel includes a flat top surface and a second surface that is angled downward to the back panel of the container.

6. The container of claim 1 wherein the body comprises a corrugated packaging.

7. The container of claim 4 wherein the corrugated packaging comprises corrugated cardboard.

8. A substance container, the container comprising:

a body including a front panel, a back panel, a first side panel, a second side panel, a top panel, a bottom support and a bottom panel;

a first aperture located in the front panel, wherein the first aperture accommodates a dispensing assembly; and a second aperture located in the top panel wherein the second aperture accommodates a filling assembly; and wherein the first side panel, the second side panel, the bottom panel and the back panel form a cavity below the bottom support that accessible from an outside of the body without disassembling the body, wherein an opening of the cavity is positioned on the front panel having the aperture to accommodate the dispensing assembly.

9. The container of claim 8 further including a bag contained in the body.

10. The container of claim 8 wherein the bottom support is positioned at an angle relative to a plane represented by the bottom panel of the body.

11. The container of claim 10 further including insulation disposed on a least a portion of an interior surface of the body.

12. The container of claim 8 wherein the top panel includes a flat top surface and a second surface that is angled downward to the back panel of the container.

13. The container of claim 8 wherein the body comprises a corrugated packaging.

14. The container of claim 13 wherein the corrugated packaging comprises corrugated cardboard.

* * * * *

UNITED STATES PATENT AND TRADEMARK OFFICE

CERTIFICATE OF CORRECTION

PATENT NO. : 8,056,763 B2
APPLICATION NO. : 12/835341
DATED : November 15, 2011
INVENTOR(S) : Matthew R. Cook et al.

It is certified that error appears in the above-identified patent and that said Letters Patent is hereby corrected as shown below:

In the Claims

In column 8, claim 4, line 18, before "least a portion of an interior surface" replace "on a" with --on at--.

In column 8, claim 11, line 46, before "least a portion of an interior surface" replace "on a" with --on at--.

Signed and Sealed this
Sixth Day of March, 2012

David J. Kappos

David J. Kappos
*Director of the United States Patent and Trademark Office*